US007778589B2

(12) United States Patent
Axten et al.

(10) Patent No.: US 7,778,589 B2
(45) Date of Patent: Aug. 17, 2010

(54) METHOD AND APPARATUS FOR SHEET HANDLING IN AN IMAGING DEVICE

(75) Inventors: Bruce A Axten, Camas, WA (US); Daniel J. Magnusson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 836 days.

(21) Appl. No.: 11/000,132

(22) Filed: Nov. 30, 2004

(65) Prior Publication Data

US 2006/0115307 A1 Jun. 1, 2006

(51) Int. Cl.
*G03G 15/00* (2006.01)

(52) U.S. Cl. ..... 399/389; 400/624; 400/708

(58) Field of Classification Search ..... 399/389, 399/394, 361, 396, 387, 386, 16, 17, 370, 399/371, 376, 405; 400/582, 595, 596, 597, 400/589, 624, 625, 636, 708, 709
See application file for complete search history.

(56) References Cited

U.S. PATENT DOCUMENTS

| | | | | |
|---|---|---|---|---|
| 4,467,949 | A | 8/1984 | Nakata | |
| 4,941,017 | A * | 7/1990 | Mishima et al. | 399/193 |
| 5,299,873 | A | 4/1994 | Miebori | |
| 5,738,457 | A * | 4/1998 | Ishida et al. | 400/706 |
| 5,946,527 | A * | 8/1999 | Salgado et al. | 399/82 |
| 6,126,160 | A * | 10/2000 | Ebert et al. | 271/10.03 |
| 6,418,279 | B1 | 7/2002 | Weinberger et al. | |
| 6,435,641 | B1 * | 8/2002 | Tung et al. | 347/16 |
| 6,637,852 | B2 | 10/2003 | Bjune | |
| 7,068,969 | B2 * | 6/2006 | Ueda | 399/388 |
| 2002/0006287 | A1 * | 1/2002 | Dobberstein et al. | 399/45 |
| 2003/0196564 | A1 * | 10/2003 | Sejima et al. | 101/477 |
| 2004/0041869 | A1 * | 3/2004 | Horiuchi et al. | 347/16 |

* cited by examiner

*Primary Examiner*—Ren Yan

(57) ABSTRACT

A method and apparatus for adjusting the print area by positioning a sheet in an imaging device utilizing length data from a prior sheet. A first sheet length is measured and thereafter utilized to determine the print zone for a subsequent sheet.

8 Claims, 5 Drawing Sheets

METHOD AND APPARATUS FOR SHEET HANDLING IN AN IMAGING DEVICE

FIELD OF THE DISCLOSURE

The present disclosure relates generally to a method and apparatus for handling sheet feeding in an imaging device. More specifically, the present disclosure relates to adjusting the print area on a sheet based in part on the detected lengths of prior sheets.

BACKGROUND OF THE INVENTION

A print zone in a printing context is the area of a media sheet where the printer may create an image of text, drawing or other data as required by a user. Controlling the print zone is an important design and operational criteria for a printer. Should the print zone be too short, then the user will not be able to print much material on a particular sheet. However, if the print zone is too large, then some of the printing may occur outside of the print zone and off of the actual sheet. In such a case, material such as footnotes, page numbers and the like may not be printed on the sheet which may lead to user dissatisfaction.

Some ways of controlling the print zone to ensure that data is printed on the sheet and not lost includes assuming a shorter print zone than might be able to be printed on a sheet therefore ensuring that the print zone always falls within the sheet. Another way of controlling the print zone is to use expensive optical sensors which may accurately detect the leading edge of a sheet which may then be used to adjust the print zone for the printer. However, optical sensors are very expensive and therefore increase the cost of the printing device to the users. Given the highly competitive market place for printing devices today, an increase in cost is a significant factor for manufacturers and consumers to consider.

Other factors that affect a print zone includes tolerances within the printer, tolerances within the sheet media and, in some circumstances, the speed with which the sheets are fed through the printing device. For example, as a printer is used there is some inherent wear in feed rollers, motor bearings and other parts which lead to variations in how a sheet is picked from the storage tray and fed through the printer. These variations may be sufficient to cause differences in the print zone over time. The differences in sheet media can also introduce variations which must be accounted for. In particular, different weights of paper may feed differently creating variations in how the printer feeds the sheet and therefore the resultant print zone. The speed with which the sheets are fed through the printing device can also be a factor as the gap between the trailing edge of a leading sheet and leading edge of a trailing sheet may become so small that errors in sensors may be introduced which leads to print zone variations. All these variations must be taken into account in the design and operation of a printing device to ensure that the print zone remains on a sheet.

Therefore, it would be advantageous, for a printing device to be able to adjust for changes that may occur such that the print zone from one page to another remains in an acceptable range for the user.

BRIEF DESCRIPTION OF THE DRAWINGS

The invention can be better understood with reference to the following drawings. The attached drawings, in which like references indicate like parts, are included solely to illustrate a preferred embodiment of the present invention without lending the invention in any manner whatsoever.

DETAILED DESCRIPTION OF THE INVENTION

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
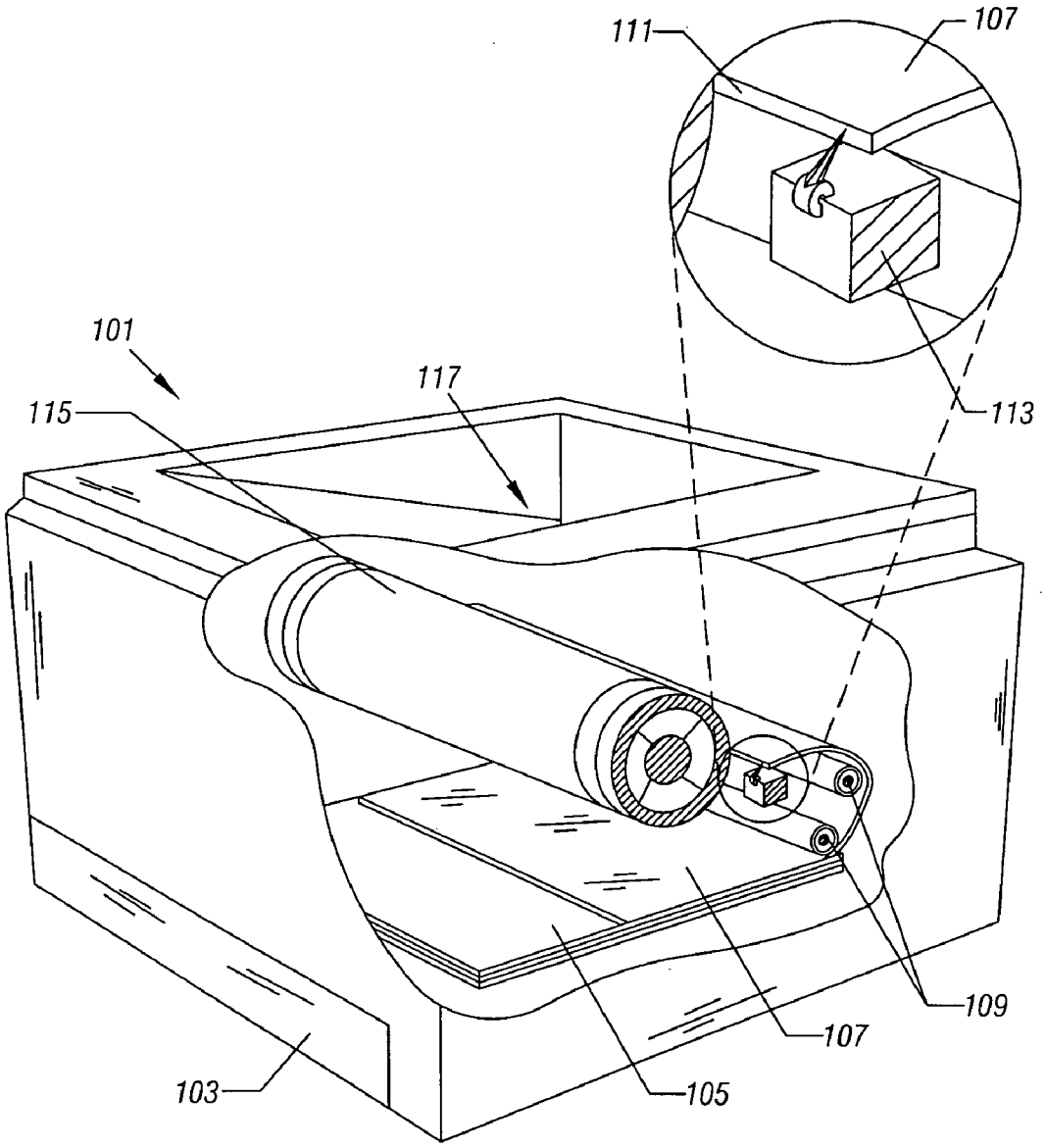
FIG. 1 illustrates a printing device according to an embodiment of the present invention which illustrates detecting the leading edge of a sheet.

FIG. 1 illustrates an embodiment of the present invention wherein a printing device 101 includes a sheet tray 103 having a plurality of sheets 105 therein. A top sheet 107 is picked from the sheet tray 103 by rollers 109. The leading edge of sheet 107 is detected by an edge detector 113 as sheet 107 passes over the detector 113. Subsequently, sheet 107 passes around roller 115 wherein an image is deposited on sheet 107 and the sheet is thereafter deposited in sheet tray 117.

Figure 2:
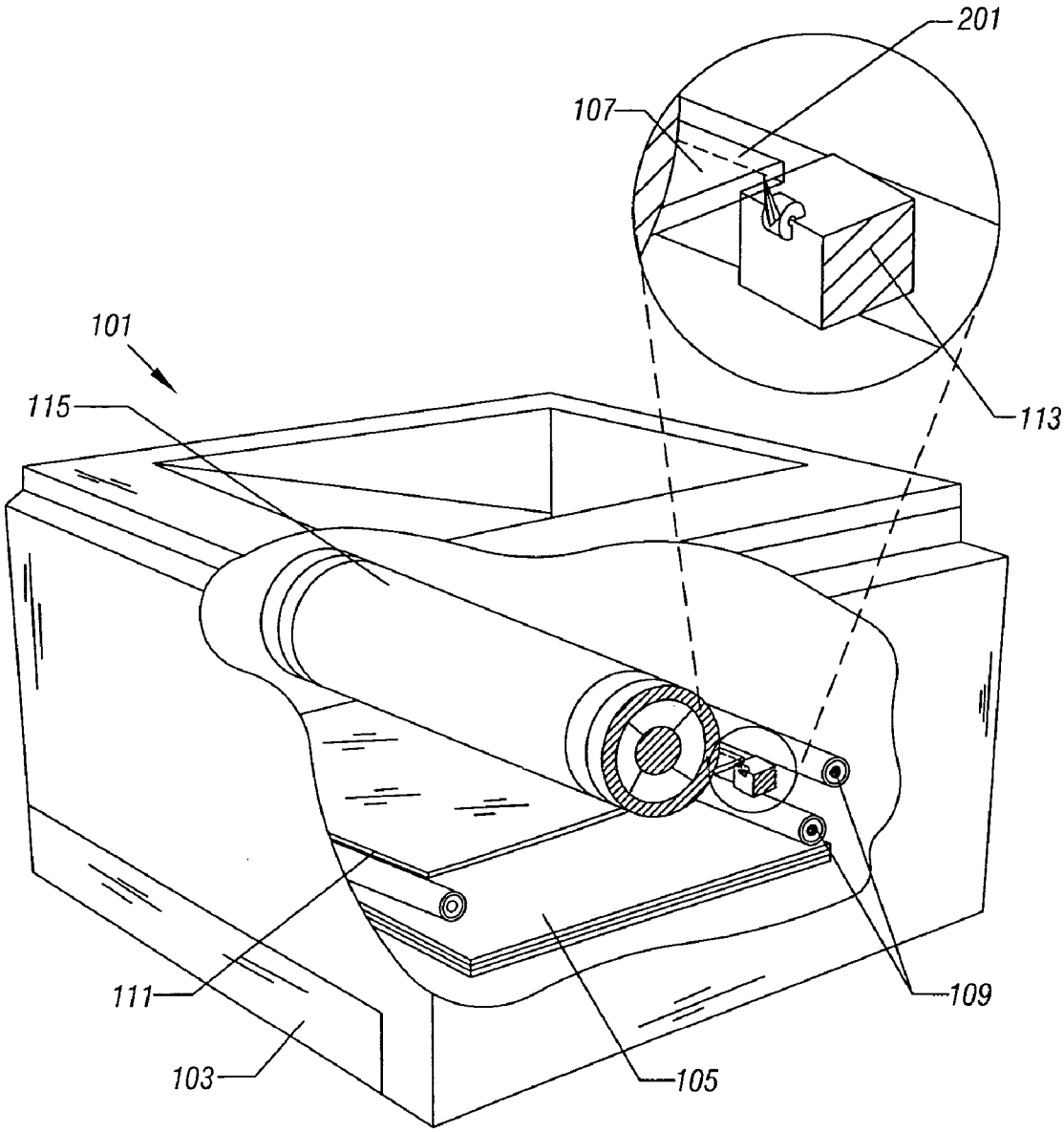
FIG. 2 illustrates an embodiment of the present invention wherein a printing device detects the trailing edge of a sheet.

FIG. 2 illustrates the printing device of FIG. 1 wherein the sheet 107 has moved through the printer such that a trailing edge 201 is now detected by the edge sensor 113. The roller 109 and the drum 115 are driven, in some embodiments, by a stepper motor such that the sheet 107 and subsequent sheets are picked from the tray 103 and driven through the printing device 101. A stepper motor, not shown, may typically be used for such a drive system and by the nature of this operation, moves a set amount in response to a signal from a stepper motor controller such as will be described in association with FIG. 4. Of course, other drive mechanisms besides stepper motors may also be usefully employed to drive sheets through the printing device 101.

It should be appreciated that the sheets 105 while illustrated as rectangular sheets, may be any type of suitable sheet media material and may come in various sizes of plain paper, coated paper, card-stock, envelopes, transparencies and the like. The sheet tray 103 may also include one or more adjustment mechanisms for accommodating different sizes of print sheets such as a sliding length adjustment lever, a sliding width adjustment lever and other mechanisms known in the art. In some embodiments, a sensor associated with the paper tray, or otherwise positioned in the printing device, may indicate to a processor or like device controlling the printing device the sheet type and/or the size of the sheet being fed.

This information may be used by the printing device to determine a default print zone for that particular sheet.

As was discussed previously, due to the different weights of paper sheets, and other tolerance issues, a mechanism is advantageously incorporated within the printer device 101 to make sure the print zone remains in an acceptable range and position on a printed sheet. Although the edge detector 113 may detect a leading and a trailing edge of a sheet such as sheet 107, due to various tolerances within the detector, due to mechanical issues and the like, may cause variations in the detected edge either of the leading edge such as 111 or trailing edge such as 201 from their actual position within the printing device 101.

Figure 3:
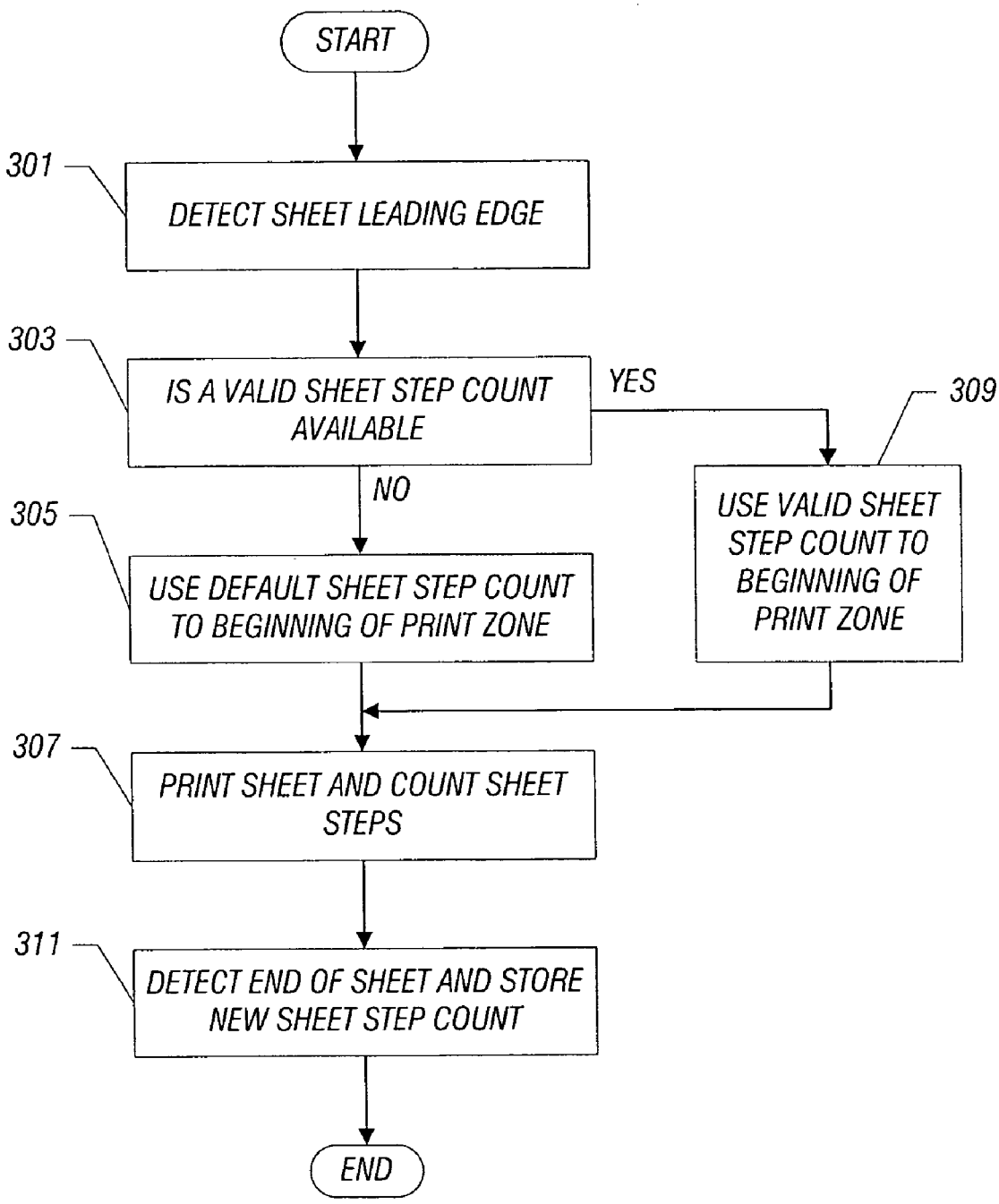
FIG. 3 illustrates a flow chart of a method that may be used to control the print zone of a printing device according to some embodiments of the present invention.
Figure 4:
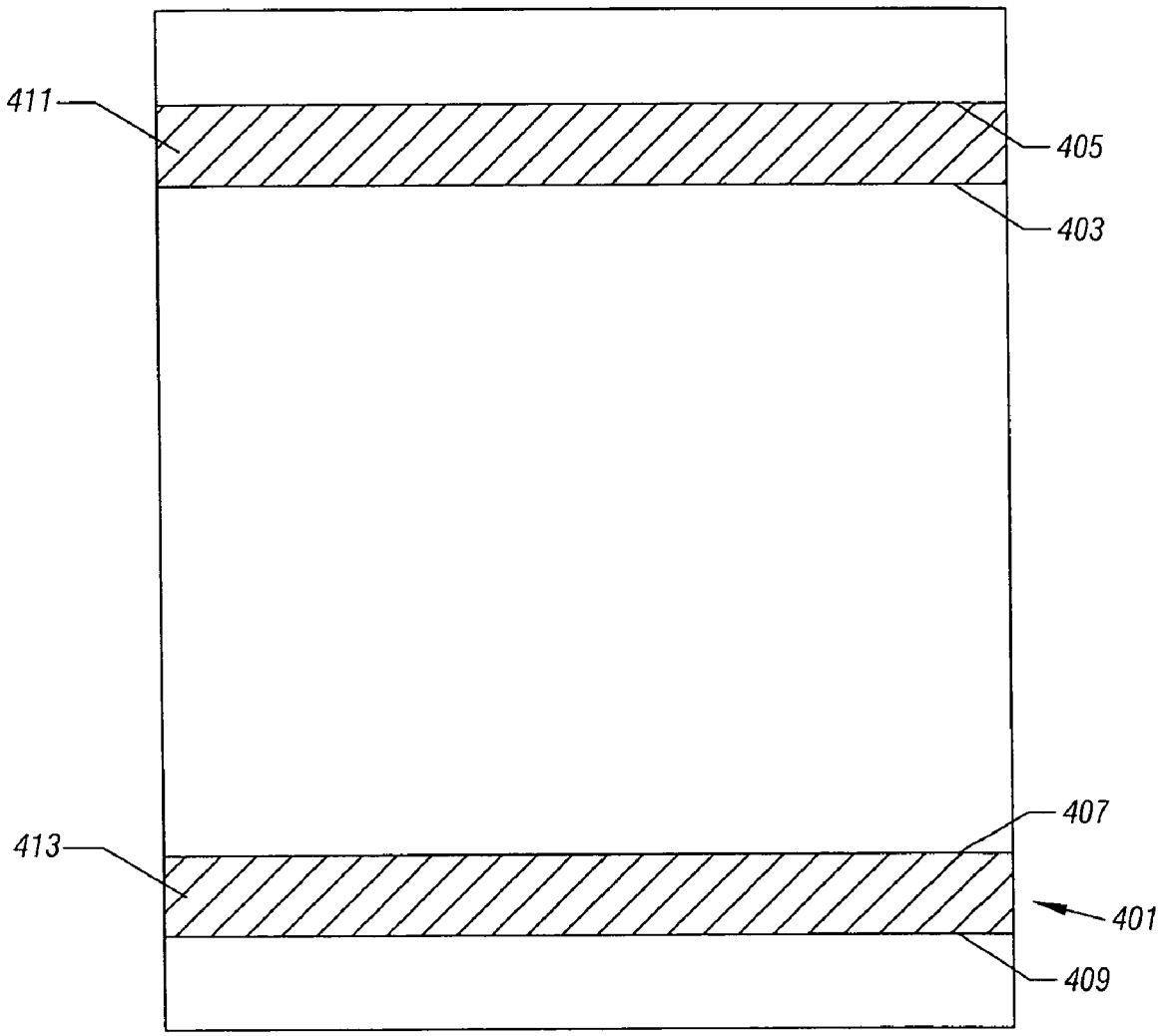
FIG. 4 illustrates a sheet with different print zones depicted, not to scale, in accordance with some embodiments of the invention.

FIG. 3 illustrates a flowchart for a method of controlling the print image in a printing device according to some embodiments of the present invention. Once the process starts, a leading edge is detected, 301, and a test is conducted at step 303 to determine if a valid sheet step count is available. Such a step count may have been stored previously during the operation of the printer. If such a step count is not available then at step 305 the printing device 101 will use a default sheet step count to position the sheet such as sheet 107 at the beginning of a print zone. The default sheet step count may be provided in some embodiments by either preprogrammed data that may be residing in the controller, such as illustrated in FIG. 4, of the printing device 101 or may be passed to the printing device 101 by an external processing means such as an attached computer, not shown.

The printing device 101 may use information from one or more sheet sensors to determine the sheet size and type to thereby determine the default step count to utilize.

If at step 303 a valid sheet step count is available then the printing device 101 will use the valid sheet step count to determine the beginning of a print zone as indicated in step 309. Whether the valid sheet step count is available such as in step 309 or a default sheet step count is used as in step 305, the step count available be it the default step count or the valid step count is utilized to position the sheet such as sheet 107 at the proper location to correspond with the beginning of a print zone on the sheet.

Once the sheet is properly positioned at the beginning of a print zone, then the sheet may have an image printed on it and as the image is being printed, the sheet is being advanced by a stepper motor, not shown. After the image has been transferred to the sheet such as sheet 107, the end or trailing edge of the sheet such as trailing edge 201 will be detected by a sensor such as sensor 113. Once the trailing edge has been detected, then the number of steps from the leading edge such as leading edge 111 to the trailing edge such as trailing edge 201 will be known and that step count may be stored in a memory such as memory 503 as a valid sheet step count as illustrated in step 311. Other types of sheet drive systems, other than stepper motor systems, may also be employed from which the length of the sheet may also be determined and stored in a memory such as memory 503 to be used to adjust the print zone on subsequent sheets.

The method illustrated in FIG. 3 allows the printing device such as printing device 101 to print a first sheet based on a default sheet step count and measure the length of the first sheet to thereby determine a valid sheet step count for use in adjusting the print zone on prior sheets that may be fed through the printing device 101. In this way, the actual detected lengths of the sheets are taken into account to adjust the print zone such that a printer adapts to changes in either the tolerances of the various sheets such as 105 and to tolerances within the printer 101 such as the print zone may be adjusted to fit within an optimum location on the subsequent sheets utilized by the printing device 101.

FIG. 4 illustrates a media sheet 401 having a first print zone starting line 403 and a second print zone starting line 405. Additionally, the sheet 401 has a first print zone ending line 407 and a second print zone ending line 409.

The first print zone may be considered to start at line 403 and end at line 407. This first print zone may be the default print zone utilized by the printing device 101 if a valid sheet step count is not available as was described in association with FIG. 3. In such a case, the printing device may use a default step count to begin imaging at line 403 and then continue to image until the default end line 407 is reached at which point the sheet is typically ejected. This default step count may be prestored in a memory such as memory 503 or, in some embodiments, the default step count may be downloaded to the printing device 101 by a processing or other device attached to a data input circuit such as Data Input 509. This data input circuit may be designed to handle parallel, serial or other data formats. The default step count is conservative in that it is determined such that there is little risk of part of an image being off the sheet of a given default media size such as, 8.5"×11" or A4 as just two examples of media sizes.

The second print zone may be considered to start at line 405 and end at line 409. This second print zone may be utilized if a valid sheet step count is available. By using a valid sheet step count determined as described in association with FIG. 3, the additional imaging areas 411 and 413 may be utilized on the sheet 401. Since the length of the sheet 401 may be reasonably assumed to be very similar to a prior sheet of the same media size measured as described in association with FIG. 3, there is little risk that using the additional areas 411 and 413 will result in part of the image being off the sheet 401. Once the printing device 101 has imaged to the line 409, then a sheet feeder mechanism 508 of the printing device 101 will eject the sheet. The printing device may eject the sheet by continuing to step the sheet through the printing device or by use of a separate sheet ejector mechanism.

Figure 5:
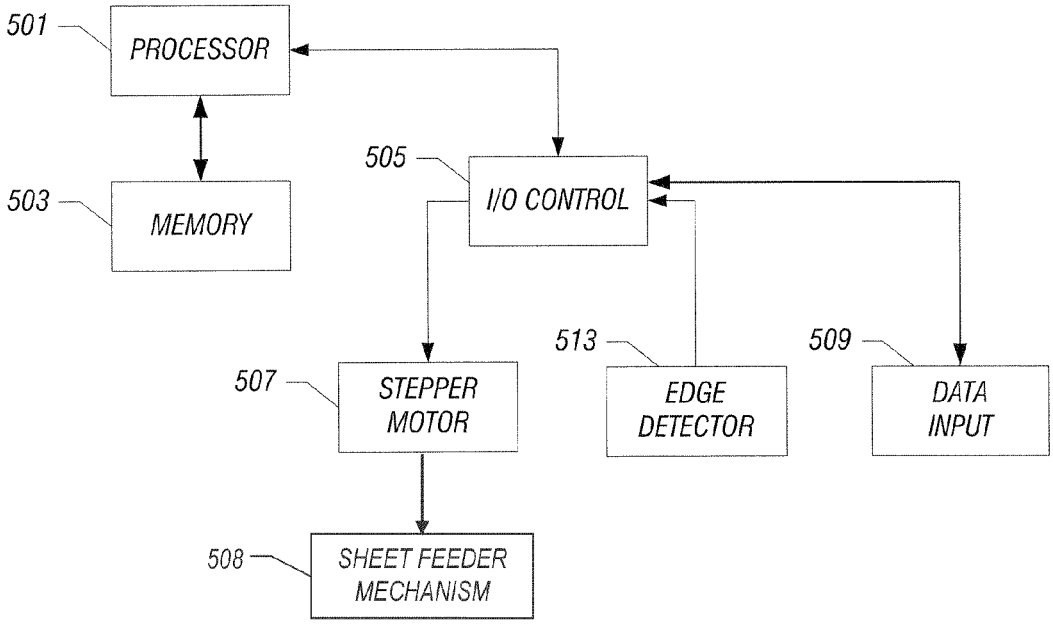
FIG. 5 illustrates a block diagram of a processor controlled system for controlling the print zone of a printing device in accordance with some embodiments of the present invention

FIG. 5 illustrates a process-based controller for a printer device such as printer device 101 that may be utilized to accomplish the method illustrated in FIG. 3 to control the print zone on sheets. A processor 501 may be coupled to a memory 503. The memory 503 may store program information utilized by processor 501 to control the various printing functions of the printing device 101. In addition, memory 503 may store a default sheet step count and or a valid sheet step count as may be utilized in association with the process described and illustrated in association with FIG. 3.

An I/O control device 505 may be coupled to the processor 501 such that the processor 501 may control a stepper motor 507 that may be utilized by printer device 101 to drive the sheet feeder mechansism 508 to move the sheets such as sheet 105 through the printing device. Additionally, the edge detector 113 may be coupled through the I/O control to processor 501 so that processor 501 may detect either a leading or a trailing edge of a sheet.

A data input circuit 409 may be utilized to provide the processor 501 with data that a user may wish to be imaged by the printing device 101. In addition, the data input circuit 509 may also be utilized to output status data to an external computer, not shown.

Of course, variations, modifications and changes to the present invention will make themselves apparent to one skilled in the art from a reading of the present disclosure. All such modifications, variations and changes are intended to fall within the scope of the present invention only limited by the appended claims. For example, while a printing device 101 is illustrated as an electrophotographic printer, other printer devices such as inkjet printing devices may also be utilized advantageously to implement the described herein invention. Also, the terms imaging and printing are intended to be defined broadly and may encompass text or graphics.

We claim:

1. A printing apparatus comprising:

a first sheet length determining apparatus operative to determine the length of a first sheet having a first print zone and to store the determined first sheet length in a memory; and a sheet positioner operative to position a second sheet at a start position, wherein the start, position is at a first distance removed from a leading edge of the first sheet and corresponds to a start of a second print zone different from the first print zone, and wherein the first distance is determined, in part, from the determined length of the first sheet.

2. The apparatus as in claim 1 wherein the sheet positioner is operative to eject the second sheet after the second sheet is moved a second distance from the start position to an end position that corresponds to an end of the second print zone, wherein the second distance is determined, in part, from the determined length of the first sheet.

3. The apparatus as in claim 1 wherein the first sheet length determining apparatus is operative to detect a leading edge of the first sheet;

to detect a trailing edge of the first sheet; and to determine the distance between the first sheet leading edge and the first sheet trailing edge.

4. The apparatus as in claim 1 wherein the second print zone is larger than the first print zone.

5. A printing apparatus comprising:

a sheet positioner operative to position a first sheet at a first start position based on detecting a leading edge of the first sheet and moving the first sheet a first predetermined distance after the leading edge is detected, wherein the first start position corresponds to a start of a first print zone;

the sheet positioner operative to eject the first sheet after the first sheet is positioned at a second predetermined distance after the leading edge was detected;

a sheet measurement device to measure the length from the leading edge of the first sheet to a trailing edge of the first sheet; and the sheet positioner also operative to position a second sheet at a second start position based on detecting a leading edge of the second sheet and moving the second sheet a third distance from the detected leading edge of the second sheet, wherein the third distance is determined based, in part, on the measured length of the first sheet, and wherein the second start position corresponds to a start of a second print zone different from the first print zone.

6. The apparatus as in claim 5 wherein the first predetermined distance the first sheet is moved to the first start position from the detected leading edge of the first sheet is greater than the third distance the second sheet is moved from the detected leading edge of the second sheet to the second start position.

7. The apparatus as in claim 6 wherein the second sheet is ejected after the second sheet is positioned at a fourth distance after the leading edge of the second sheet is detected, wherein the fourth distance is determined based, in part, on the measured length of the first sheet.

8. The apparatus as in claim 7, wherein the second predetermined distance from the detected leading edge of the first sheet is less than the fourth distance from the detected leading edge of the second sheet.

* * * * *

UNITED STATES PATENT AND TRADEMARK OFFICE

CERTIFICATE OF CORRECTION

PATENT NO. : 7,778,589 B2
APPLICATION NO. : 11/000132
DATED : August 17, 2010
INVENTOR(S) : Bruce A. Axten et al.

It is certified that error appears in the above-identified patent and that said Letters Patent is hereby corrected as shown below:

In column 5, line 14, in Claim 1, delete “start,” and insert -- start --, therefor.

Signed and Sealed this
Eighth Day of March, 2011

David J. Kappos

David J. Kappos
*Director of the United States Patent and Trademark Office*